US007798854B2

(12) United States Patent
Tanaka

(10) Patent No.: US 7,798,854 B2
(45) **Date of Patent: *Sep. 21, 2010**

(54) CONNECTOR

(75) Inventor: Yukitaka Tanaka, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/363,864

(22) Filed: Feb. 2, 2009

(65) Prior Publication Data

US 2009/0197441 A1 Aug. 6, 2009

(30) Foreign Application Priority Data

Feb. 4, 2008 (JP) ..... 2008-024294

(51) Int. Cl.
*H01R 13/648* (2006.01)

(52) U.S. Cl. ..... 439/608; 439/78

(58) Field of Classification Search ..... 439/78, 439/608

See application file for complete search history.

(56) References Cited

U.S. PATENT DOCUMENTS 6,935,870 B2 8/2005 Kato et al.

FOREIGN PATENT DOCUMENTS

JP 2002-334748 A 11/2002

*Primary Examiner*—Truc T Nguyen
(74) *Attorney, Agent, or Firm*—Frishauf, Holtz, Goodman & Chick, P.C.

(57) ABSTRACT

A connector which is capable of preventing degradation of transmission, and achieving downsizing. Contact portions of first and second signal contacts, and contact portions of ground contacts are arranged in a row in a contact arranging direction. Contact portions of contacts for non-high-speed transmission are arranged in a row in the contact arranging direction. The row formed by the contact portions of the first and second signal contacts, and the contact portions of the ground contacts, and the rows formed by the contact portions of the contacts for non-high-speed transmission are parallel. The contact portions of each pair of first and second signal contacts are disposed between the contact portions of adjacent ones of the ground contacts in the contact arranging direction.

12 Claims, 9 Drawing Sheets

CONNECTOR

BACKGROUND OF THE INVENTION

1. Field of the Invention

This invention relates to a connector, more particularly to a connector which is suitable for high-speed transmission of electric signals.

2. Description of the Related Art

Conventionally, there has been proposed a receptacle connector comprised of three types of contacts, an insulator for holding the contacts, and a receptacle shell for covering the insulator (see Japanese Laid-Open Patent Publication (Kokai) No. 2002-334748).

The three types of contacts include a signal contact S and a ground contact G for high-speed transmission, and a contact D for non-high-speed transmission. Each of the three types of contacts has contact portions which are capable of being brought into contact with contact portions of mating contacts of a mating connector, and terminal portions which are capable of being soldered to pads on a printed board.

The contact portions are arranged in two rows, one above the other (see FIG. 7(*b*) in the above-mentioned Patent Publication). In the upper row, the contact portions are disposed in the order of D, D, D, G, S, S, G, S, and S from the left side as viewed from the front side of the insulator. In the lower row, the contact portions are disposed in the order of D, D, S, S, G, S, S, and G from the left side as viewed from the front side of the insulator. One ground contact G in the upper row and a pair of signal contacts S and S in the lower row which are located below the ground contact G form one contact group for high-speed transmission, while one ground contact G in the lower row and a pair of signal contacts S and S in the upper row which are located above the ground contact G form one contact group for high-speed transmission.

The terminal portions are arranged in a row along the direction of the width of the insulator (the contact arranging direction) (see FIG. 7(*a*) in the above-mentioned Patent Publication). In this row, the terminal portions are disposed in the order of D, D, D, D, D, S, G, S, S, G, S, S, G, and S from the left side of the insulator. One ground contact G and a pair of signal contacts S and S located on opposite sides of the ground contact G form one contact group for high-speed transmission.

In the above-described arrangement of the contact portions, only the pair of signal contacts S located at a right end in the upper row are not in a state sandwiched by ground contacts G. As a result, variation in transmission characteristics is caused between the pair of signal contacts S and the other pairs of signal contacts, and there is a fear that crosstalk may occur between the pair of signal contacts S and other pairs of signal contacts located obliquely below.

Further, in the arrangement of the terminal portions, the signal contacts of adjacent contact groups in the direction of the width of the insulator are adjacent to each other, and hence there is a fear that crosstalk occurs between these signal contacts.

Furthermore, since the terminal portions are arranged in a row along the direction of the width of the insulator, the connector suffers from the problem of an increase in size.

SUMMARY OF THE INVENTION

The present invention has been made in view of these circumstances, and an object thereof is to provide a connector which is capable of preventing degradation of transmission, and achieving downsizing.

To attain the above object, the present invention provides a connector comprising a housing that is capable of being fitted to a mating housing of a mating connector, and a plurality of contacts that are held by the housing, the plurality of contacts including pairs of signal contacts for high-speed transmission, ground contacts for high-speed transmission, and contacts for non-high-speed transmission, wherein each of the signal contacts for high-speed transmission, the ground contacts for high-speed transmission, and the contacts for non-high-speed transmission has a contact portion which is capable of being brought into contact with a contact portion of a mating contact of the mating connector, and a connection portion which is connected to an object to be connected, wherein the contact portions of the signal contacts for high-speed transmission and the contact portions of the ground contacts for high-speed transmission are arranged in a row in a contact arranging direction which is orthogonal to a connector fitting direction, wherein the contact portions of the contacts for non-high-speed transmission are arranged in a row in the contact arranging direction, wherein the row formed by the contact portions of the signal contacts for high-speed transmission and the contact portions of the ground contacts for high-speed transmission, and at least one row formed by the contact portions of the contacts for non-high-speed transmission are parallel to each other, wherein each pair of the contact portions of the signal contacts for high-speed transmission is disposed between adjacent ones of the contact portions of the adjacent ground contacts for high-speed transmission in the contact arranging direction, wherein the connection portions of the signal contacts for high-speed transmission and the connection portions of the ground contacts for high-speed transmission are arranged in a row in the contact arranging direction, wherein the connection portions of each pair of the signal contacts for high-speed transmission are disposed between adjacent ones of the connection portions of the adjacent ground contacts for high-speed transmission in the contact arranging direction, wherein the connection portions of the contacts for non-high-speed transmission are arranged in a row in the contact arranging direction, and wherein the row formed by the connection portions of the signal contacts for high-speed transmission and the connection portions of the ground contacts for high-speed transmission, and the row formed by the connection portions of the contacts for non-high-speed transmission are parallel to each other.

With the arrangement of the connector according to the present invention, the contact portions of the signal contacts for high-speed transmission and the contact portions of the ground contacts for high-speed transmission are arranged in a row in the contact arranging direction which is orthogonal to the connector fitting direction; the row formed by the contact portions of the signal contacts for high-speed transmission and the contact portions of the ground contacts for high-speed transmission, and the row formed by the contact portions of the contacts for non-high-speed transmission are parallel to each other; the contact portions of each pair of signal contacts for high-speed transmission are disposed between the contact portions of adjacent ones of the ground contacts for high-speed transmission in the contact arranging direction; and the contact portions of the contacts for non-high-speed transmission are arranged in a row in the contact arranging direction. Therefore, variation of transmission characteristics and crosstalk are suppressed.

Further, the connection portions of the signal contacts for high-speed transmission and the connection portions of the ground contacts for high-speed transmission are arranged in a row in the contact arranging direction; the connection portions of each pair of signal contacts for high-speed transmission are disposed between the connection portions of adjacent ones of the ground contacts for high-speed transmission in the contact arranging direction; the connection portions of the contacts for non-high-speed transmission are arranged in the contact arranging direction; and the row formed by the connection portions of the signal contacts for high-speed transmission and the connection portions of the ground contacts for high-speed transmission, and at least one row formed by the connection portions of the contacts for non-high-speed transmission are parallel to each other. Therefore, no contacts for high-speed transmission in one pair are adjacent in the contact arranging direction to any contacts for high-speed transmission in other pairs. This suppresses crosstalk, and makes it possible to downsize the connector.

Preferably, the connection portions of the contacts for non-high-speed transmission are arranged in two rows in the contact arranging direction, and are in staggered arrangement, and the row formed by the connection portions of the contacts for high-speed transmission and the connection portions of the ground contacts for high-speed transmission, and the two rows formed by the connection portions of the contacts for non-high-speed transmission are parallel to each other.

Preferably, the plurality of contacts each have a substantially L-shape.

Preferably, the plurality of contacts each have a substantially linear shape.

More preferably, the connection portions of the plurality of contacts each have a planar shape of a surface-mounting type.

Preferably, each of the plurality of contacts is formed by blanking and bending a metal plate having elasticity.

According to this invention, it is possible to prevent degradation in transmission and downsize the connector.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1A:
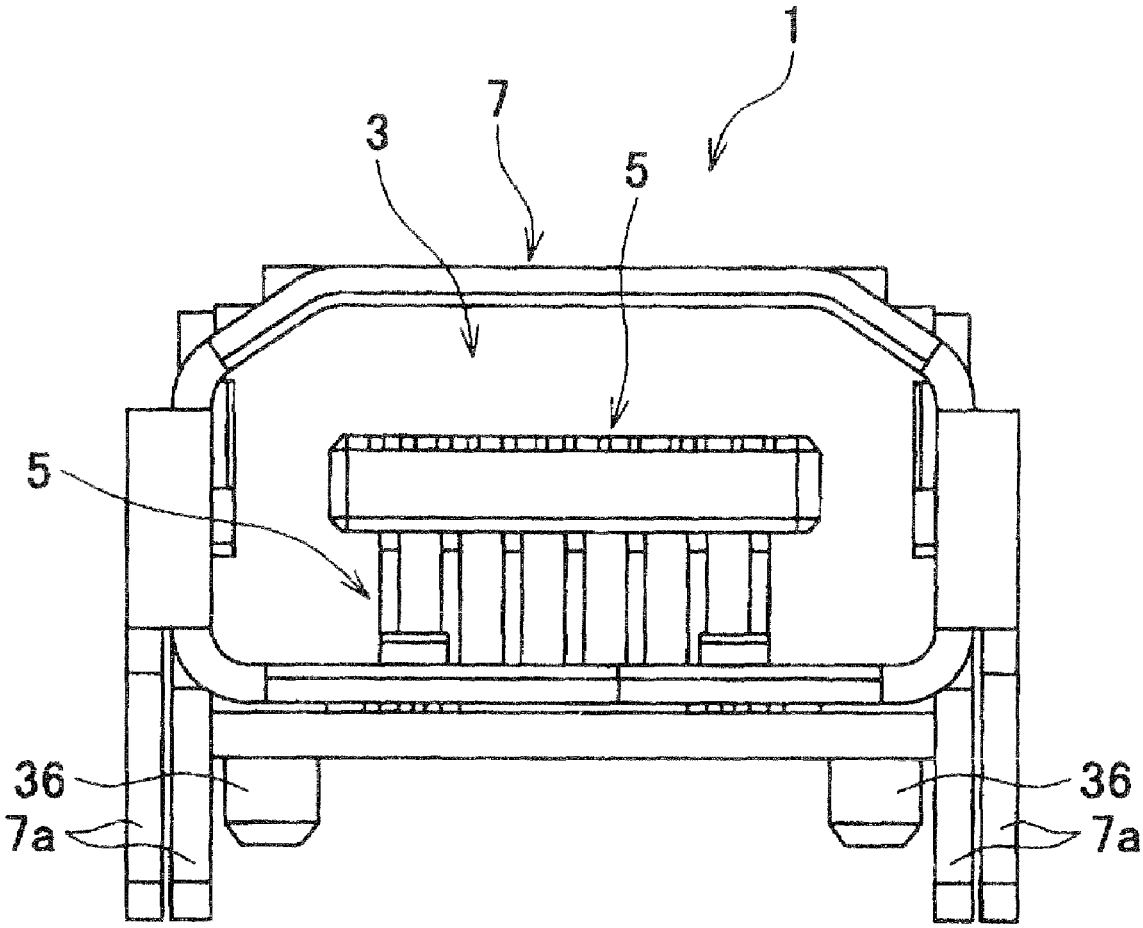
FIG. 1A is a front view of a connector according to a first embodiment of the present invention.
Figure 1B:
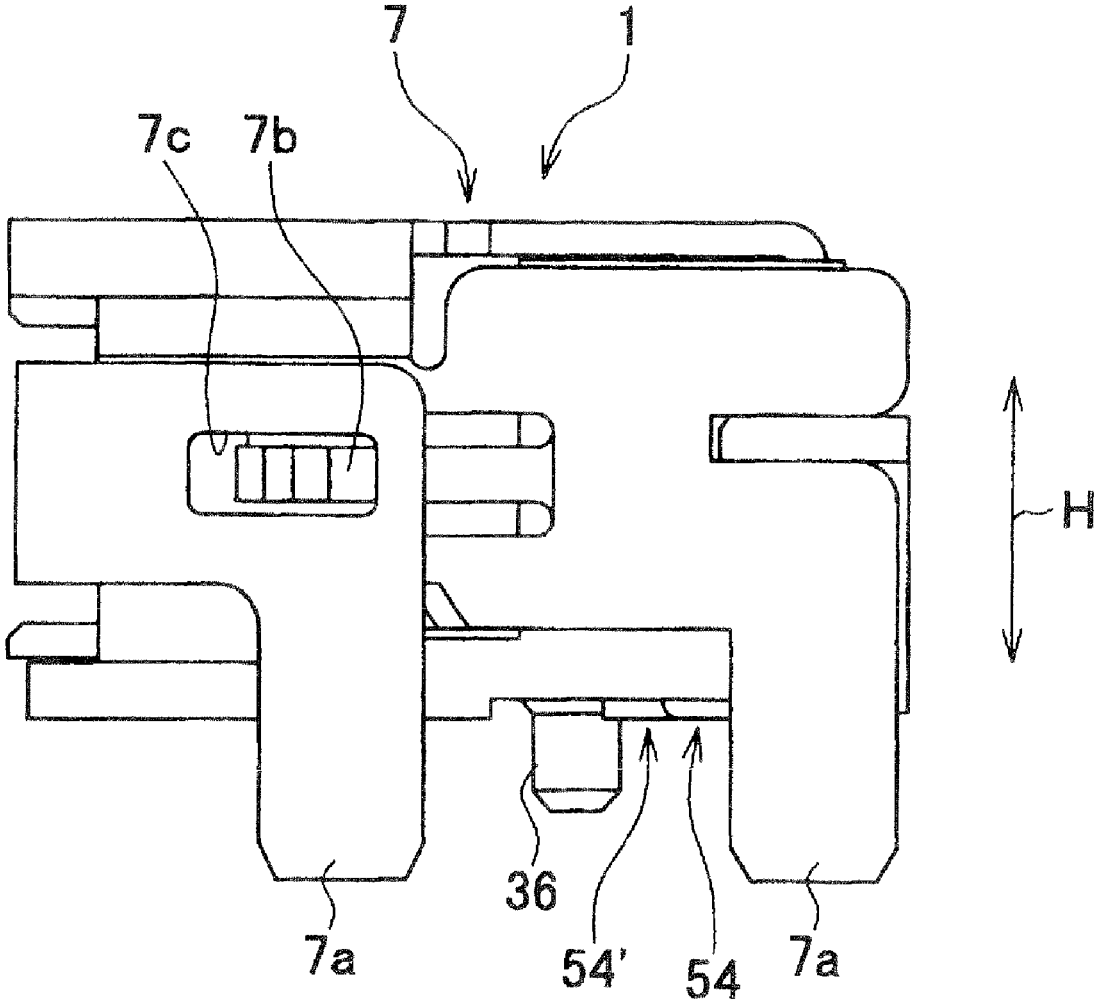
FIG. 1B is a side view of the connector.
Figure 1C:
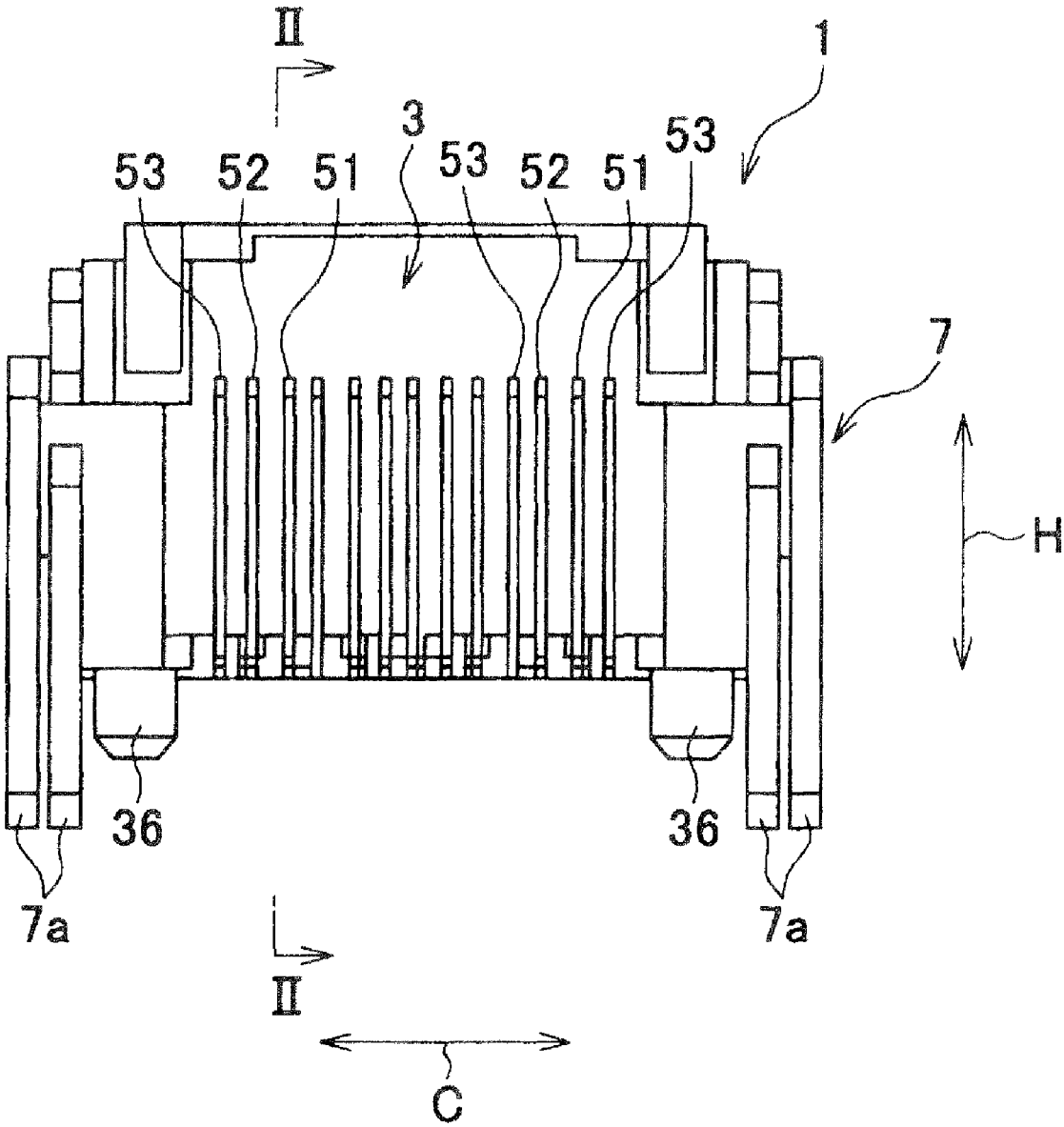
FIG. 1C is a rear view of the connector.
Figure 2:
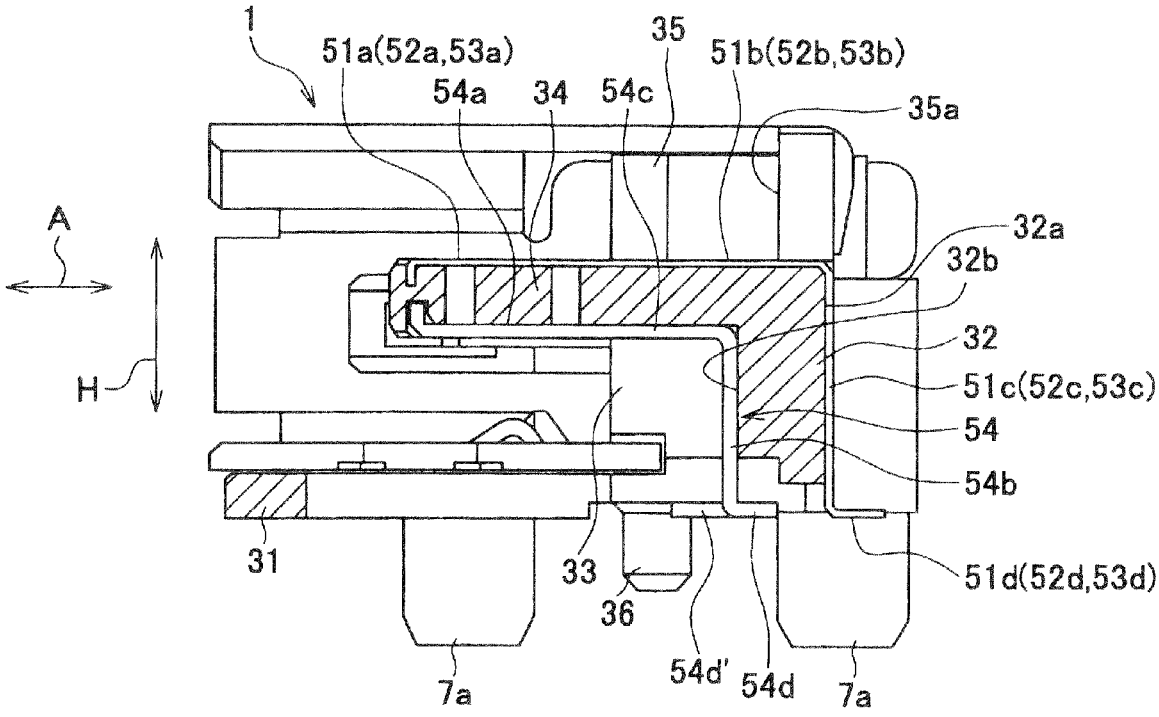
FIG. 2 is a cross-sectional view taken on line II-II of FIG. 1C.

Referring to FIGS. 1A to 2, a connector 1 is comprised of a housing 3, a plurality of contacts 5, and a shell 7.

The housing 3 is made of a resin having insulation properties. The housing 3 includes a bottom board 31, a rear wall portion 32, side wall portions 33, a holding portion 34, and a projecting portion 35 (see FIG. 2). The bottom board 31 has a plate-like shape, and has a bottom surface formed with a pair of positioning bosses 36. The positioning bosses 36 are inserted in positioning holes of a printed board (object to be connected), not shown. The rear wall portion 32 is continuous with the rear of the bottom board 31. The rear wall portion 32 has a rear-side surface (outer surface) thereof formed with a plurality of press-fitting grooves 32*a*, and a front-side surface (inner surface 9 thereof formed with a plurality of press-fitting grooves 32*b*, at equally-spaced intervals, respectively. The press-fitting grooves 32*a* and 32*b* extend in a direction H of the height of the housing 3. Two side wall portions 33 are continuous with the opposite sides of the rear wall portion 32. The holding portion 34 has a plate-like shape, and is continuous with the rear wall portion 32. The holding portion 34 extends along a fitting/removing direction A (connector fitting direction) in which the housing 3 is fitted in and removed from a mating housing 203 of a mating connector 201 (see FIGS. 5A to 6), and is parallel to the bottom board 31. The projecting portion 35 is continuous with the rear wall portion 32, both of the side wall portions 33, and the holding portion 34. An impedance value is adjusted by the projecting portion 35. The projecting portion 35 has a hole 35*a* formed therein for adjusting the impedance value.

Figure 3:
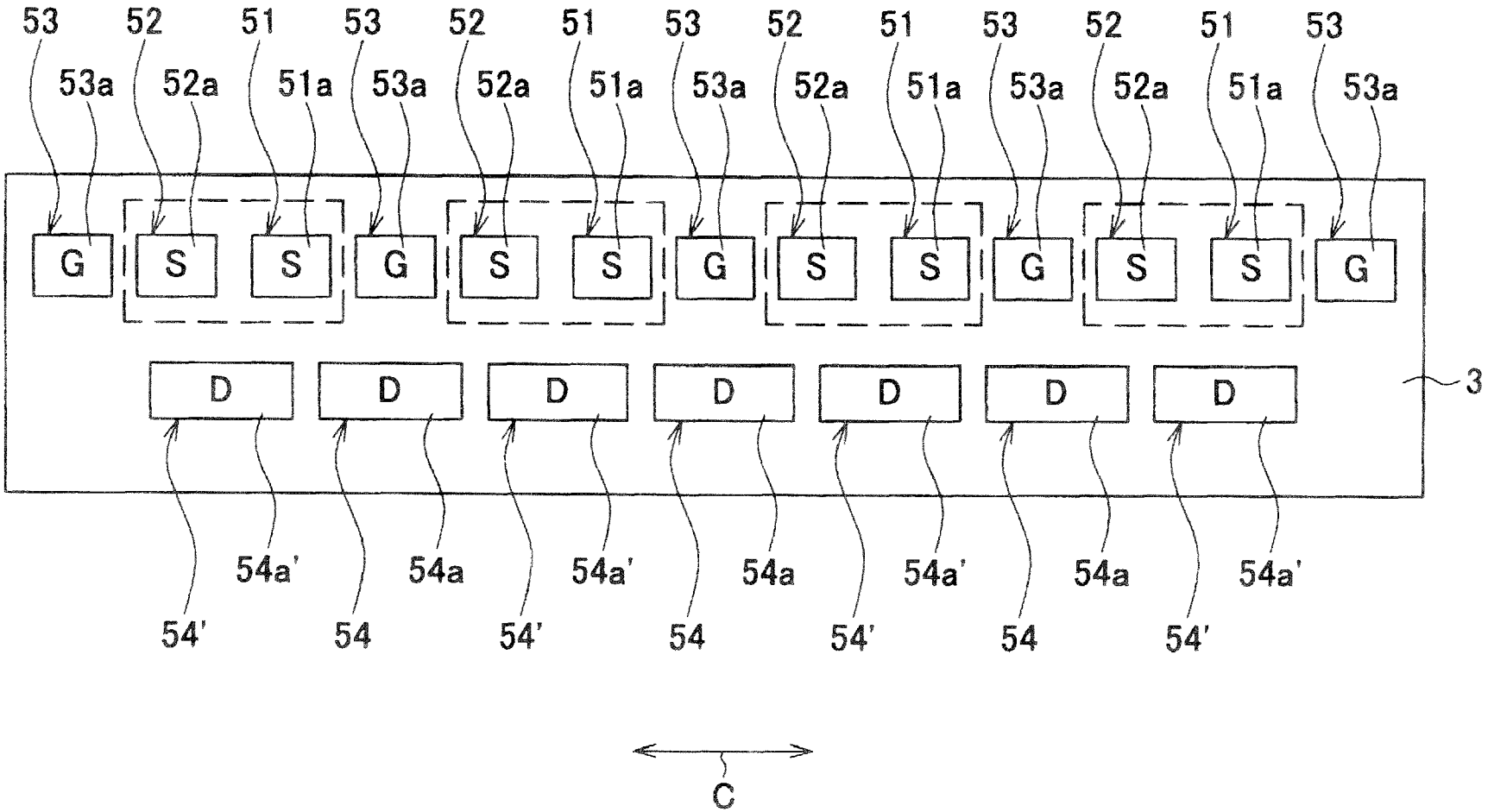
FIG. 3 is a perspective view of an arrangement of contact portions of contacts of the connector shown in FIGS. 1A to 1C.
Figure 4:
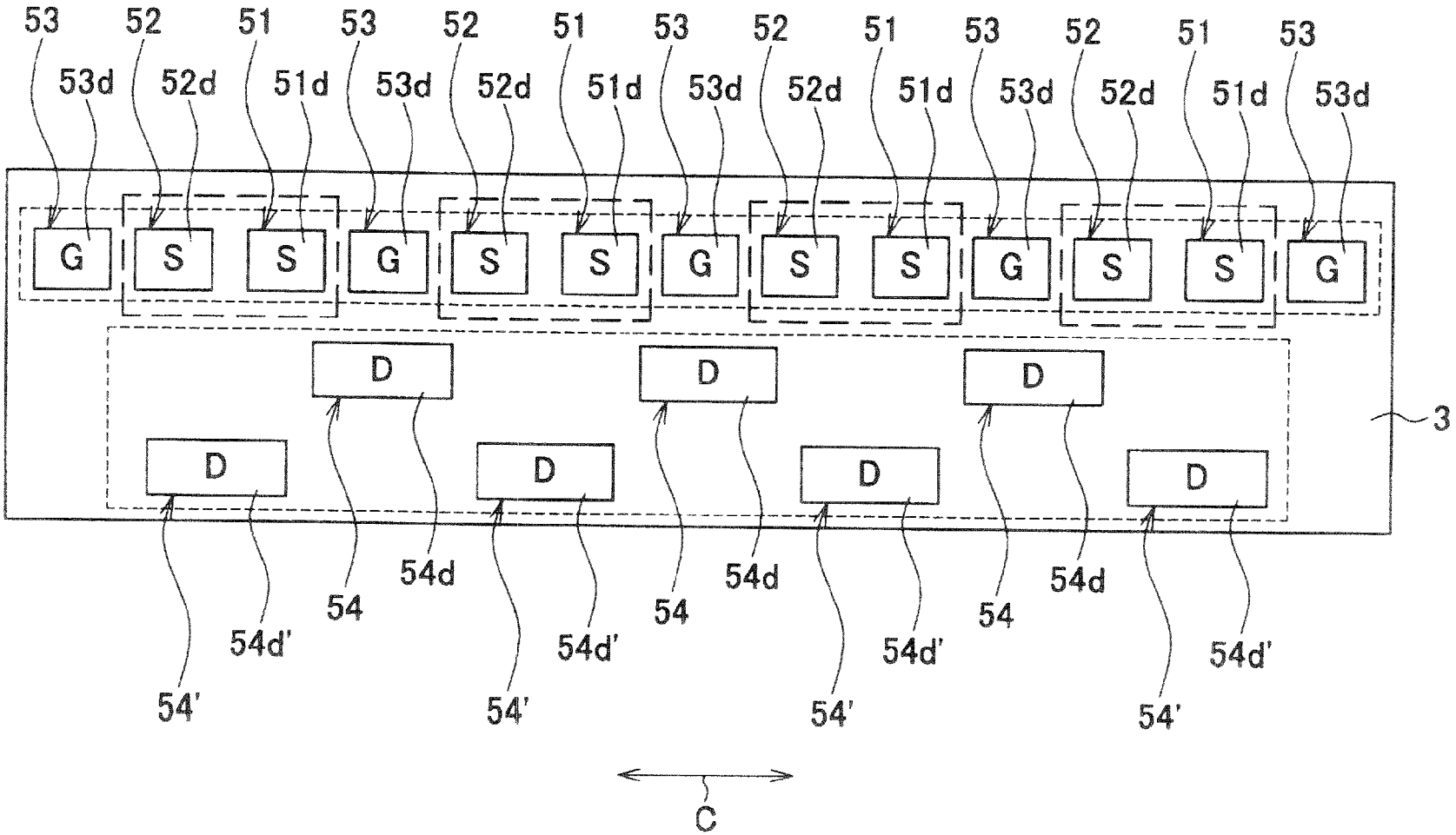
FIG. 4 is a perspective view of an arrangement of terminal portions of the contacts of the connector shown in FIGS. 1A to 1C.

Referring to FIGS. 3 and 4, the contact 5 includes contacts for high-speed transmission, and contacts 54, 54' for non-high-speed transmission. The contacts for high-speed transmission includes first signal contacts (signal contacts for high-speed transmission) 51, second signal contacts (signal contacts for high-speed transmission) 52, and ground contacts (ground contacts for high-speed transmission) 53. These contacts 51, 52, and 53 are disposed at predetermined space intervals in the housing 3. The contacts 54 for non-high-speed transmission and the contacts 54' for non-high-speed transmission are alternately arranged in the housing 3 at equally-spaced intervals. One first signal contact 51 and one second signal contact 52 form a pair of signal contacts for high-speed transmission. A pair of signal contacts 51, 52 for high-speed transmission, and one ground contact 53 form one contact group for differential signal transmission.

Each first signal contact 51 has a contact portion 51*a*, a fixing portion 51*b*, a connecting portion 51*c*, and a terminal portion (connection portion) 51*d* (see FIG. 2), and is formed by blanking and bending a metal plate having elasticity. The contact portions 51*a* are brought into contact with contact portions (contact portions of mating contacts) of contacts 251 of the connector 201 as the mating connector shown in FIGS. 5A to 6. The contact portions 51*a* are disposed on the upper surface of the holding portion 34. The fixing portion 51*b* is embedded the housing 3 by a so-called mold-in method. The connecting portion 51*c* connects the fixing portion 51*b* and the terminal portion 51*d*. The terminal portion 51*d* is continuous with the connecting portion 51*c*. The terminal portion 51*d* has a planar shape of a surface-mounting type, and is soldered to a pad (not shown) on the printed board.

The second signal contact 52 has the same shape as the first signal contact 51, and hence reference numerals associated with the second signal contact 52 (52*a* to 52*d*) are shown in parentheses beside reference numerals associated with the first signal contact 51 (51*a* to 51*d*), and illustration of the second signal contacts 52 is omitted from FIG. 2. Each second signal contact 52 has a contact portion 52*a*, a fixing portion 52*b*, a connecting portion 52*c*, and a terminal portion (connection portion) 52*d*, and is formed by blanking and bending a metal plate having elasticity. The contact portions 52*a* are brought into contact with contact portions (contact portions of the mating contacts) of contacts 252 of the connector 201 as the mating connector. The contact portions 52*a* are disposed on the upper surface of the holding portion 34. The fixing portion 52*b* is embedded in the housing 3 by the so-called mold-in method. The connecting portion 52*c* connects the fixing portion 52*b* and the terminal portion 52*d*. The terminal portion 52*d* is continuous with the connecting portion 52*c*. The terminal portion 52*d* is of a surface-mounting type, and is soldered to a pad (not shown) on the printed board.

The ground contact 53 has the same shape as the first signal contact 51, and hence reference numerals associated with the ground contact 53 (53*a* to 53*d*) are shown in parentheses beside the reference numerals associated with the first signal contact 51 (51*a* to 51*d*), and illustration of the ground contacts 53 is omitted from FIG. 2. Each ground contact 53 has a contact portion 53*a*, a fixing portion 53*b*, a connecting portion 53*c*, and a terminal portion (connection portion) 53*d*, and is formed by blanking and bending a metal plate having elasticity. The contact portions 53*a* are brought into contact with contact portions (contact portions of mating contacts) of contacts 253 of the connector 201 as the mating connector. The contact portions 53*a* are disposed on the upper surface of the holding portion 34. The fixing portion 53*b* is embedded in the housing 3 by the so-called mold-in method. The connecting portion 53*c* connects the fixing portion 53*b* and the terminal portion 53*d*. The terminal portion 53*d* is continuous with the connecting portion 53*c*. The terminal portion 53*d* is of a surface-mounting type, and is soldered to a pad (not shown) on the printed board.

Each contact 54 for non-high-speed transmission has a contact portion 54*a*, a press-fitting portion 54*b*, and a terminal portion (connection portion) 54*d*, and is formed by blanking and bending a metal plate having elasticity. The contact portions 54*a* are brought into contact with contacts portions (contact portions of mating contacts) of contacts 254 of the connector 201 as the mating connector. The contact portions 54*a* are disposed on the lower surface of the holding portion 34. The press-fitting portion 54*b* is press-fitted in a associated one of the press-fitting grooves 32*b* of the housing 3. The terminal portion 54*d* is of a surface-mounting type, and is soldered to a pad (not shown) on the printed board.

The contact 54' for non-high-speed transmission has a similar configuration as the contact 54 except the direction in which a terminal portion 54*d*' is folded. The terminal portion 54*d*' is folded forward, and is disposed forward of the press-fitting portion 54*b* (see FIG. 2). As a result, the terminal portions 54*d* and 54*d*' are in staggered arrangement (see FIG. 4). Therefore, if the terminal portions 54*d* and 54*d*' are connected by imaginary straight lines, one zigzag line is formed in which mountain-like shapes each in bilateral symmetry are connected in a contact arranging direction C.

The shell 7 has electrical conductivity, and has leg parts 7*a* and contact parts 7*b*. The leg parts 7*a* are soldered to through holes (not shown) of the printed board, and are grounded via these through holes. The contact parts 7*b* are brought into contact with a shell 207 of the connector 201 as the mating connector via window holes 7*c* formed in side walls of the shell 7 (see FIGS. 5A and 5B).

As shown in FIG. 3, the contact portions 51*a* and 52*a* of the first and second signal contacts 51 and 52, and the contact portions 53*a* of the ground contacts 53 are arranged in a row in the contact arranging direction C which is orthogonal to the fitting/removing direction A, respectively. The contact portions 54*a* and 54*a*' of the contacts 54 and 54' are also arranged in a row in the contact arranging direction.

The row formed by the contact portions 51*a* and 52*a* of the first and second signal contacts 51 and 52, and the contact portions 53*a* of the ground contacts 53, and the row formed by only the contact portions 54*a* and 54*a*' of the contacts 54 and 54' are parallel to each other.

The contact portions 51*a* and 52*a* of each pair of first and second signal contacts 51 and 52 are disposed between the contact portions 53*a* of adjacent ones of the ground contacts 53 in the contact arranging direction C.

A pitch of the contact portions 51*a* and 52*a* of the first and second signal contacts 51 and 52 and the contact portions 53*a* of the ground contacts 53 in the contact arranging direction C in their row and a pitch of the contact portions 54*a* and 54*a*' of the contacts 54 and 54' in the contact arranging direction C in their row are different from each other.

As shown in FIG. 4, the terminal portions 51*d* and 52*d* of the first and second signal contacts 51 and 52, and the terminal portions 53*d* of the ground contacts 53 are arranged in a row in the contact arranging direction C.

The terminal portions 51*d* and 52*d* of each pair of first and second signal contacts 51 and 52 are disposed between adjacent ones of the terminal portions 53*d* of the ground contacts 53 in the contact arranging direction C.

The terminal portions 54*d* and 54*d*' of the contacts 54 and 54' are arranged in two rows in the contact arranging direction C. The row formed by the terminal portions 51*d* and 52*d* of the first and second signal contacts 51 and 52, and the terminal portions 53*d* of the ground contacts 53, and the two rows formed by the terminal portions 54*d* and 54*d*' of the contacts 54 and 54' are parallel to each other. Further, the terminal portions 54*d* of the contacts 54 and the terminal portions 54'*d* of the contacts 54' in staggered arrangement. If the terminal portions 54*d* and 54*d*' are connected by imaginary straight lines, one zigzag line is formed in which mountain-like shapes each in bilateral symmetry are connected in the contact arranging direction C.

According to this embodiment, the contact portions 51*a* and 52*a* of the first and second signal contacts 51 and 52 for high-speed transmission, and the contact portions 53*a* of the ground contacts 53 for high-speed transmission are arranged in a row in the contact arranging direction C, and the contact portions 51*a* and 52*a* of each pair of first and second signal contacts 51 and 52 are disposed between the contact portions 53*a* of the adjacent ground contacts 53 in the contact arranging direction C. This suppresses variation in transmission characteristics or crosstalk between each pair of first and second signal contacts and other pairs of first and second signal contacts, whereby it is possible to prevent degradation in transmission.

Further, the terminal portions 51*d* and 52*d* of each pair of first and second signal contacts 51 and 52 are disposed between the terminal portions 53*d* of adjacent ones of the ground contacts 53 in the contact arranging direction C. This suppresses crosstalk between the terminal portions 51*d* and 52*d* of each pair of first and second signal contacts 51 and 52, and the terminal portions 51*d* and 52*d* of other pairs of first and second signal contacts 51 and 52 which are adjacent thereto, thereby preventing degradation in transmission.

Furthermore, the row formed by the terminal portions 51*d* and 52*d* of the first and second signal contacts 51 and 52 and the terminal portions 53*d* of the ground contacts 53, and the two rows formed by the terminal portions 54*d* and 54*d*' of the contacts 54 and 54' are parallel to each other. This makes it possible to reduce the length of the housing 3 in the contact arranging direction C, and downsize the connector 1. Further, the terminal portions 54*d* of the contacts 54 and the terminal portions 54' of the contacts 54' are disposed in staggered arrangement. This makes it possible to widen the distance between adjacent pads on the printed board, and use the contacts 54 and 54' as those for power supply which requires a large pad area to be secured.

Figure 5A:
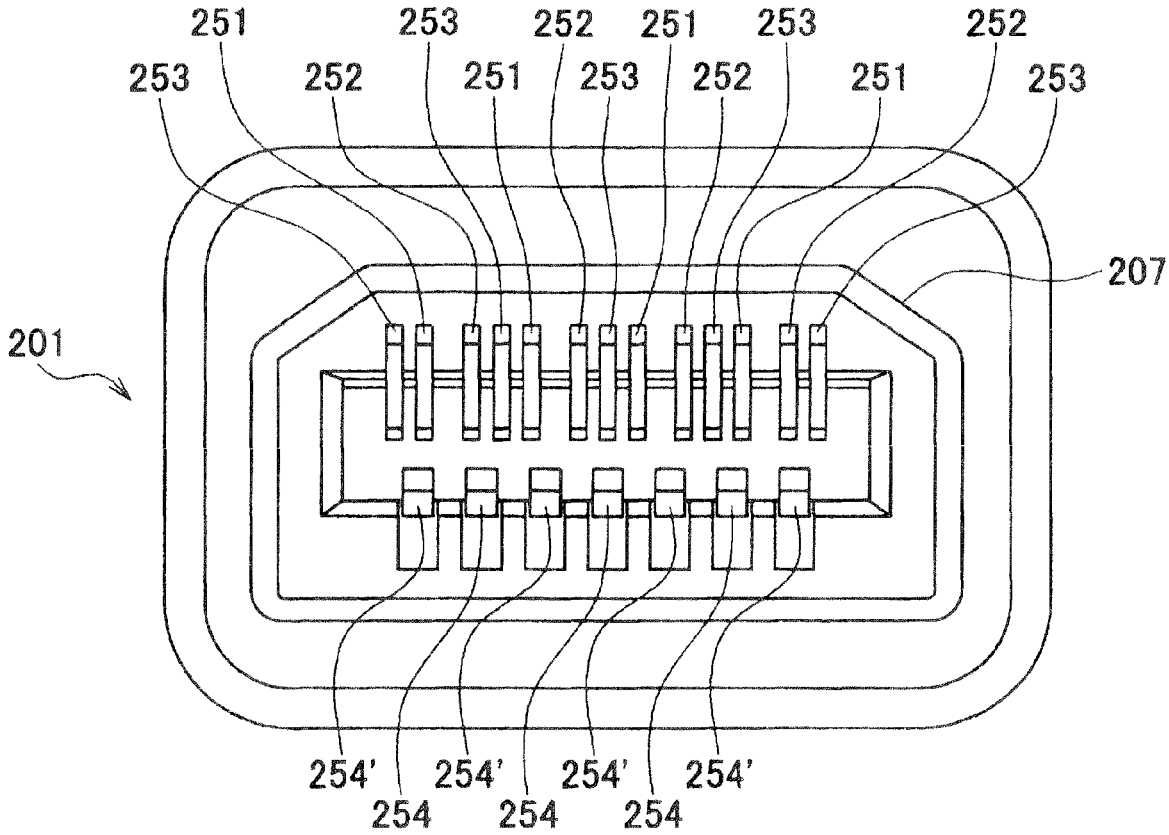
FIG. 5A is a front view of a connector according to a second embodiment of the present invention.
Figure 5B:
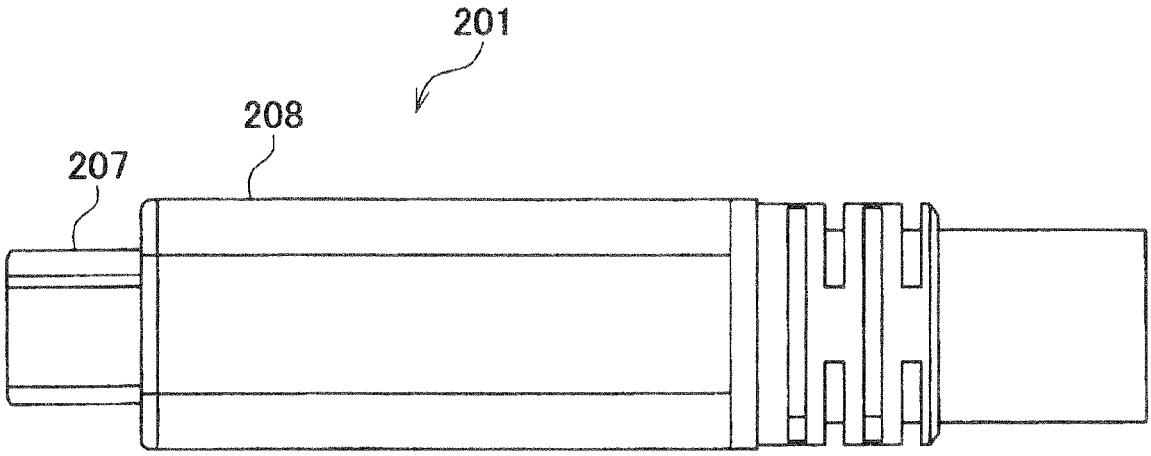
FIG. 5B is a side view of the connector.
Figure 6:
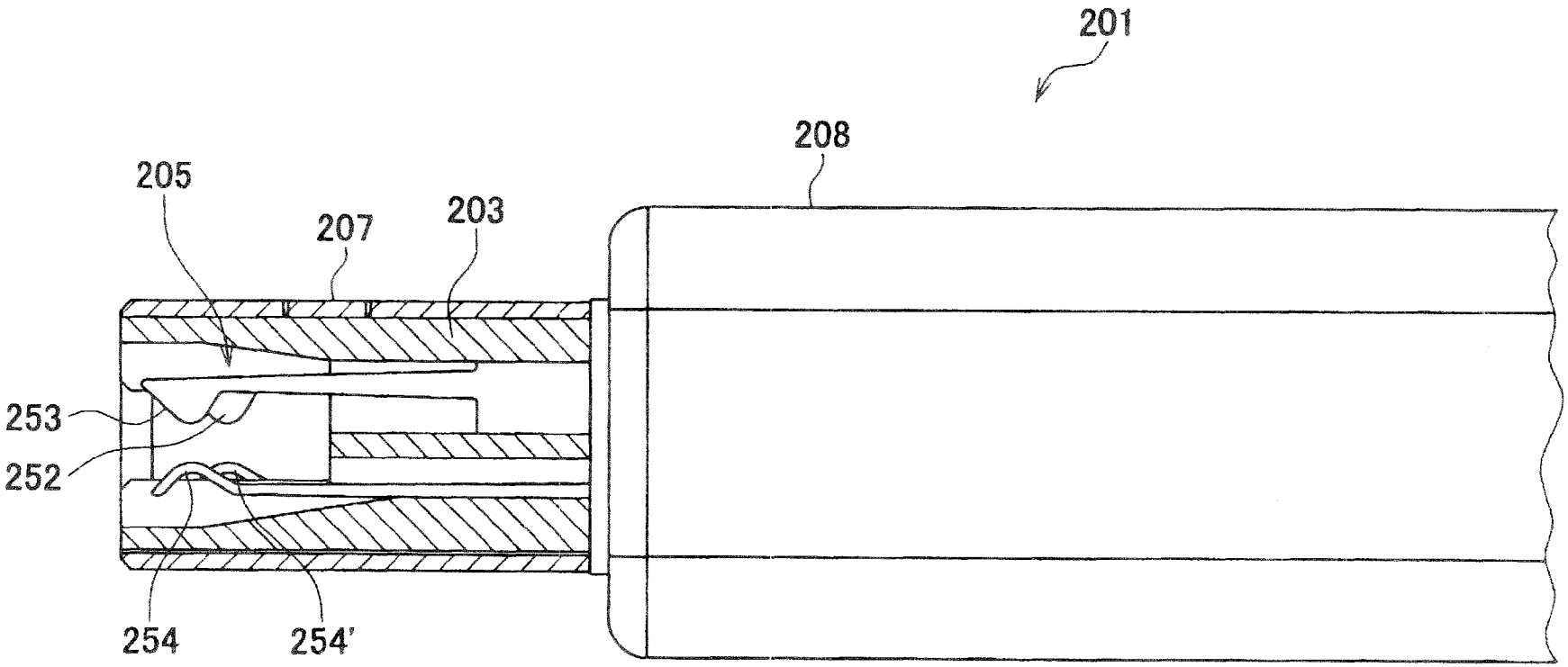
FIG. 6 is a cross-sectional view of part of the connector shown in FIG. 5A.

FIG. 5A is a front view of a connector according to a second embodiment of the present invention, and FIG. 5B is a side view of the connector. FIG. 6 is a cross-sectional view of part of the connector shown in FIG. 5A.

The connector 201 is the mating connector of the connector 1 according to the first embodiment.

Although in the connector 1, each of the first and second signal contacts 51 and 52, the ground contacts 53, and the contacts 54 and 54' for non-high speed transmission is bent into L-shape, in the connector 201, each of first and second signal contacts 251 and 252, ground contacts 253, and contacts 254 and 254' for non-high speed transmission has a linear shape.

Although in the connector 1, each of the terminal portions (connection portion) 51*d*, 52*d*, 53*d*, 54*d*, and 54*d'* of the respective contacts 51, 52, 53, 54, and 54' has a shape for being mounted on the printed board, in the connector 201, each of wiring portions (terminal portions), not shown, of respective contacts 251, 252, 253, 254, and 254' has a shape which is capable of being connected to cables.

Although in the connector 1, the terminal portions 54*d* and 54'*d* of the contacts 54 and 54' for non-high-speed transmission are in staggered arrangement and are in two rows side by side, in the connector 201, the wiring portions of the contacts 254 and 254' are arranged in a row in the connector arranging direction C. The connector 201 according to the present embodiment is the same as the connector 1 according to the first embodiment in that the row formed by the wiring portions of the contacts 254 and 254' and the row formed by the wiring portions of the contacts 251, 252, and 253 are parallel to each other.

As shown in FIG. 5A, the arrangement of the contact portions of the contacts 251, 252, 253, 254, and 254' is same as that of the contact portions 51*a*, 52*a*, 53*a*, 54*a*, and 54*a'* of the connector 1 according to the first embodiment.

The shell 207 is covered by a hood 208 which is made of a resin except the front end portion thereof.

According to the second embodiment, it is possible to obtain the same advantageous effects as provided by the first embodiment.

It should be noted, as shown in FIGS. 3, 4, and 5A that although in the above-described embodiment, the distance between each pair of signal contacts 51 and 52 for high-speed transmission, and the distance between each pair of signal contacts 251 and 252 for high-speed transmission in the contact arranging direction C are wider than the distance between each of the signal contacts 51, 52 for high-speed transmission, and each adjacent one of the ground contacts 53, and the distance between each of the signal contacts 251, 252 for high-speed transmission, and each adjacent one of the ground contacts 253, these distances may be made equal to each other.

It is further understood by those skilled in the art that the foregoing are the preferred embodiments of the present invention, and that various changes and modification may be made thereto without departing from the spirit and scope thereof.

What is claimed is:

1. A connector comprising:

a housing that is capable of being fitted to a mating housing of a mating connector; and a plurality of contacts that are held by said housing, said plurality of contacts including pairs of signal contacts for high-speed transmission, ground contacts for high-speed transmission, and contacts for non-high-speed transmission, wherein each of said signal contacts for high-speed transmission, said ground contacts for high-speed transmission, and said contacts for non-high-speed transmission has a contact portion which is capable of being brought into contact with a contact portion of a mating contact of the mating connector, and a connection portion which is connected to an object to be connected, wherein said contact portions of said signal contacts for high-speed transmission and said contact portions of said ground contacts for high-speed transmission are arranged in a row in a contact arranging direction which is orthogonal to a connector fitting direction, wherein said contact portions of said contacts for non-high-speed transmission are arranged in a row in the contact arranging direction, wherein the row formed by said contact portions of said signal contacts for high-speed transmission and said contact portions of said ground contacts for high-speed transmission, and the row formed by said contact portions of said contacts for non-high-speed transmission are parallel to each other, wherein said contact portions of each pair of said signal contacts for high-speed transmission are disposed between adjacent ones of said contact portions of adjacent ones of said ground contacts for high-speed transmission in the contact arranging direction, wherein said connection portions of said signal contacts for high-speed transmission and said connection portions of said ground contacts for high-speed transmission are arranged in a row in the contact arranging direction, wherein said connection portions of each pair of said signal contacts for high-speed transmission are disposed between adjacent ones of said connection portions of adjacent ones of said ground contacts for high-speed transmission in the contact arranging direction, wherein said connection portions of said contacts for non-high-speed transmission are arranged in the contact arranging direction, and wherein the row formed by said connection portions of said signal contacts for high-speed transmission and said connection portions of said ground contacts for high-speed transmission, and at least one row formed by said connection portions of said contacts for non-high-speed transmission, are parallel to each other.

2. A connector as claimed in claim 1, wherein said connection portions of said contacts for non-high-speed transmission are arranged in two rows in the contact arranging direction, and are in a staggered arrangement, and wherein the row formed by said connection portions of said contacts for high-speed transmission and said connection portions of said ground contacts for high-speed transmission, and the two rows formed by said connection portions of said contacts for non-high-speed transmission, are parallel to each other.

3. A connector as claimed in claim 1, wherein each of said plurality of contacts has a substantially L-shape.

4. A connector as claimed in claim 2, wherein each of said plurality of contacts has a substantially L-shape.

5. A connector as claimed in claim 1, wherein each of said plurality of contacts has a substantially linear shape.

6. A connector as claimed in claim 2, wherein each of said plurality of contacts has a substantially linear shape.

7. A connector as claimed in claim 3, wherein each of said connection portions of said plurality of contacts has a planar shape of a surface-mounting type.

8. A connector as claimed in claim 4, wherein each of said connection portions of said plurality of contacts has a planar shape of a surface-mounting type.

9. A connector as claimed in claim 1, wherein each of said plurality of contacts is formed by blanking and bending a metal plate having elasticity.

10. A connector as claimed in claim 2, wherein each of said plurality of contacts is formed by blanking and bending a metal plate having elasticity.

11. A connector as claimed in claim 3, wherein each of said plurality of contacts is formed by blanking and bending a metal plate having elasticity.

12. A connector as claimed in claim 4, wherein each of said plurality of contacts is formed by blanking and bending a metal plate having elasticity.

* * * * *